United States Patent [19]

Amana et al.

[11] 4,111,596

[45] Sep. 5, 1978

[54] TURBINE BLADE COOLING SYSTEM

[75] Inventors: Okon M. Amana, Watertown; Jean F. Louis, Brookline, both of Mass.

[73] Assignee: The United States of America as represented by the Secretary of the Navy, Washington, D.C.

[21] Appl. No.: 758,105

[22] Filed: Jan. 10, 1977

[51] Int. Cl.[2] ..... F01D 5/00

[52] U.S. Cl. ..... 415/115; 416/95; 60/39.66

[58] Field of Search ..... 415/115, 116, DIG. 1; 416/95; 60/39.66

[56] References Cited

U.S. PATENT DOCUMENTS

| | | | |
|---|---|---|---|
| 1,824,893 | 9/1931 | Holzwarth | 415/116 |
| 2,506,581 | 5/1950 | Cowles, Jr. | 415/115 |
| 2,632,626 | 3/1953 | McClintock | 60/39.66 |
| 2,648,519 | 8/1953 | Campini | 60/39.66 |
| 2,680,001 | 6/1954 | Batt | 415/115 |
| 2,857,133 | 10/1958 | Burke et al. | 415/116 |
| 2,866,313 | 12/1958 | Holl | 415/116 |
| 2,914,919 | 12/1959 | Varadi | 60/39.66 |
| 2,956,772 | 10/1960 | Freche | 60/39.66 |
| 2,981,066 | 4/1961 | Johnson | 415/116 |
| 3,043,560 | 7/1962 | Varadi | 60/39.66 |
| 3,250,512 | 5/1966 | Petrie | 60/39.66 |
| 3,453,825 | 7/1969 | May et al. | 60/39.66 |
| 3,535,873 | 10/1970 | Szydlowski | 60/39.66 |
| 3,561,882 | 2/1971 | Somers et al. | 416/95 |

FOREIGN PATENT DOCUMENTS

| | | | |
|---|---|---|---|
| 469,231 | 11/1961 | Canada | 60/39.66 |

*Primary Examiner*—C. J. Husar

*Attorney, Agent, or Firm*—R. S. Sciascia; L. I. Shrago; C. E. Vautrain, Jr.

[57] ABSTRACT

The disclosure concerns a means for cooling the leading edges and trailing edges of turbine blades by cross-stream injection. Cooling is achieved by ejecting coolant from holes opposite either the leading or trailing edges of the blades, or both, with coolant distributed by the jet mixture on the leading edge and by recirculation in the dead air region on the trailing edge.

10 Claims, 6 Drawing Figures

TURBINE BLADE COOLING SYSTEM

The present invention concerns cooling of turbine blades and, more particularly, an arrangement for effecting cooling of the trailing and leading edges of such blades by means external thereto.

The trend in gas turbines today is towards higher turbine inlet temperatures in order to achieve higher efficiency, specific output, specific fuel consumption, or specific thrust. As temperatures rise, the metal surfaces of turbines must be protected against the heat of the hot gases through some form of cooling. The types of cooling heretofore used include convection cooling, impingement cooling, film cooling and, to a much smaller extent in special applications, transpiration cooling. A common major problem with each of these techniques is that passages, whether holes or discontinuous slots, must be machined in the blades to direct the coolant to the surface of the blade where it is required. Such passages present a problem at those parts of the blade where it is necessary, for other reasons, to reduce blade thickness as much as possible. It is well established that the thicker the trailing portion of the blade, the higher are the losses associated with it. Thus, it is both desirable and necessary to cool turbine blades, and particularly the trailing portions of high inlet temperature turbine blades, without having to increase blade thickness in the order to accommodate a hole or slot in the trailing portion. The present invention overcomes the deficiencies of prior devices for effecting such cooling by providing means disposed externally of the blade to effectively cool the blade.

Accordingly, it is an object of the present invention to alleviate the overheating of high performance turbine blades without requiring passages to be made through the narrow portions of the blade.

Another object of this invention is to reduce the heating of high performance turbine blades by selectively supplying coolant externally of the blades at either the trailing or leading edges of the turbine blades.

A further object of this invention is to provide a means for cooling the trailing edges of turbine blades by inducing recirculation of coolant in the dead air region at the trailing edge without having to supply the coolant through passages in the narrow portion of the blades.

Other objects, advantages and novel features of the invention will become apparent from the following detailed description thereof when considered in conjunction with the accompanying drawings in which like numerals represent like parts throughout and wherein.

The present invention, in general, utilizes the turbine blade support member to provide for cooling of the trailing edge of the blade. Coolant flow through injection holes in the blade support or in the end wall is generally along the trailing edge of the blade with a substantial amount penetrating into the recirculation region opposite the blade end. This form of coolant flow both lowers the bulk or average temperature of the fluid in the recirculation region and cools the trailing edge, or in another embodiment the leading edge, by forming a thin blanket over it. The bulk or average temperature in the recirculation region is the constant temperature which would give the same heat transfer to the trailing edge as the actual temperature distribution produces. The lowering of bulk temperature is appreciable since only a small portion of the hot flow is entrained into the recirculation region.

Figure 1:
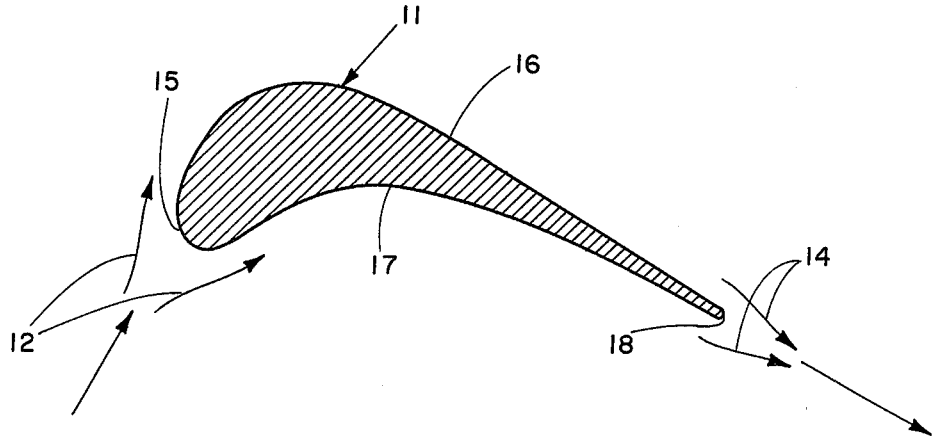
FIG. 1 is a cross-section of a high temperature gas turbine blade illustrating the gas flow pattern about the blade.
Figure 2:
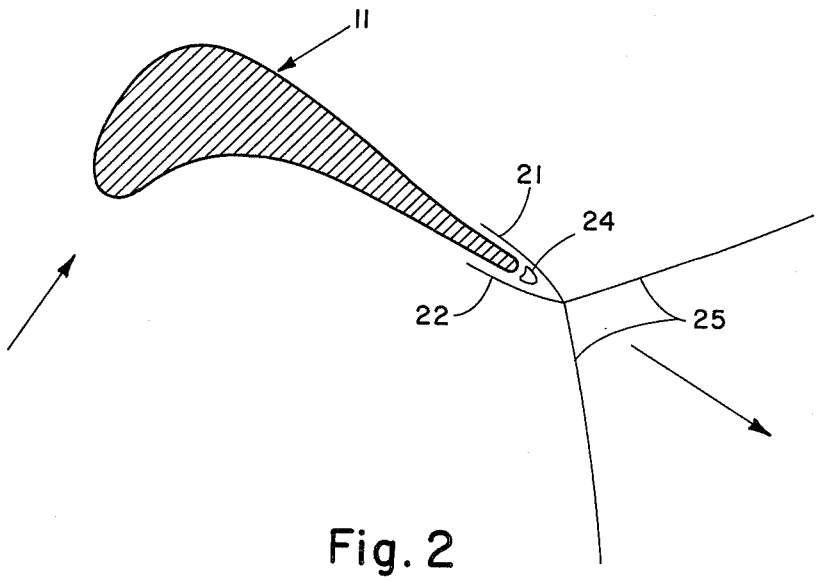
FIG. 2 is a sectional view of a high temperature gas turbine blade illustrating the recirculation region, the boundary layer, and the trailing edge shock wave associated with the turbine blade.
Figure 3:
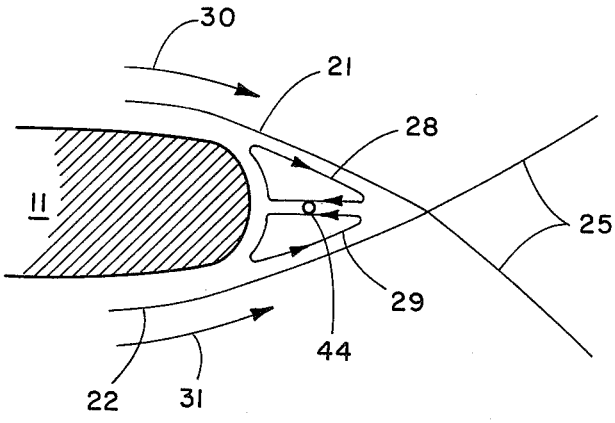
FIG. 3 is an enlarged schematic diagram of the recirculation region shown in FIG. 4.

Referring to the drawings, FIG. 1 is a sectional view of a solid turbine blade 11 and illustrates inlet flow at arrows 12 and outlet flow at arrows 14. Numeral 15 identifies the blade leading edge, 16 the blade suction side, 17 the blade pressure side, and 18 the blade trailing edge. FIG. 2 is a sectional view of the blade in FIG. 1 showing dividing streamlines at 21 and 22 along the trailing edge, the recirculation region induced by such flow at 24, and the trailing edge shock wave profile at 25. FIG. 3 is an enlarged view of recirculation region 24 in FIG. 2 for illustrating the complementary recirculating flow paths 28 and 29 which are induced by boundary layer flow indicated along the surface of blade 11. Dividing streamlines 21 and 22 are intermediate and the outer flow is indicated by arrows 30 and 31.

Figure 4:
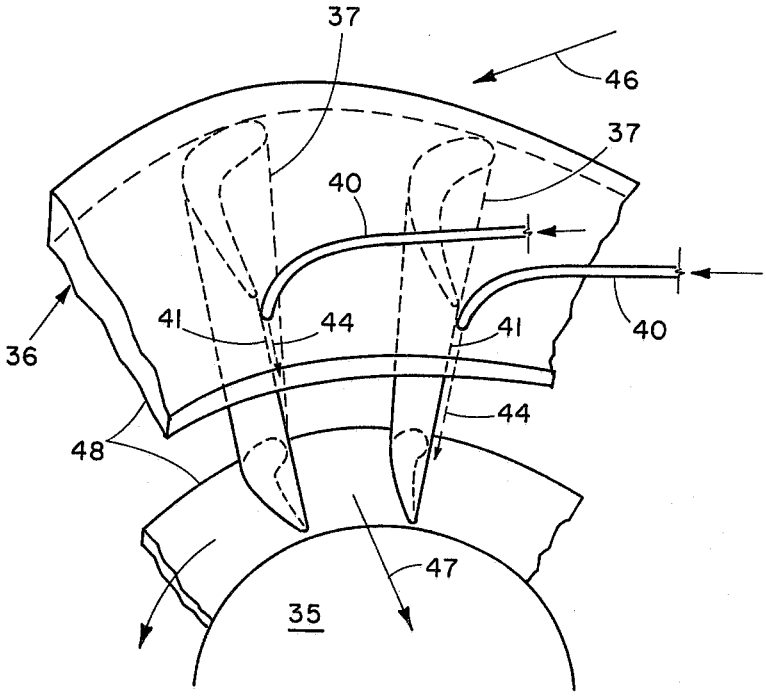
FIG. 4 is a perspective schematic view showing the principle of operation of the cooling means of the present invention in relation to the trailing edges of high temperature gas turbine blades.

The formation of recirculating flow paths 28 and 29 at the trailing edge of a transonic blade is well known, however, in the present invention these paths are utilized in a novel manner to achieve blade cooling by external means. FIG. 4 illustrates schematically this novel manner and includes a turbine having a hub 35, an end wall 36 and a plurality of blades 37. Cooling of the trailing edges of blades 37 is achieved by injecting coolant through a plurality of conduits 40 and holes 41 in end wall 36 which coolant is directed as indicated by arrows 44 along, in this case, the trailing ends of the blades, through the respective recirculating regions. The inlet flow of gases is indicated generally by arrow 46 and the outlet flow by arrow 47, while the blade passage is identified at 48. The recirculating flow indicated at 28 and 29 in FIG. 3 occurs in the recirculation region of blades 37 in FIG. 4 and supplies all the coolant which effects a lowering of the temperature of the trailing edge of each blade. This coolant flow may be provided by a compressor, not shown, and supplied either by injection through holes 41 or through other holes in the immediate vicinity of the trailing edge of the blades to form a coolant blanket over the trailing edges and also lower the bulk temperature of the fluid in the recirculating region. The bulk temperature is lowered significantly as the coolant is injected into the recirculation region in a considerable amount with only a small portion of the hot flow from the free shear layer being entrained into the recirculation region.

Figure 6:
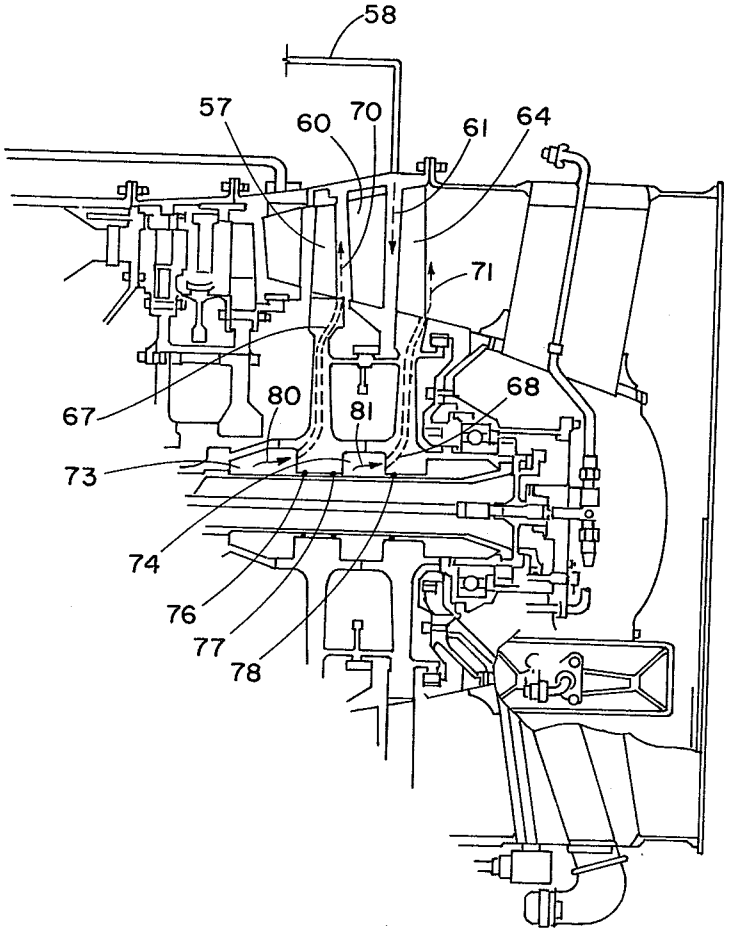
FIG. 6 is a sectional view of the turbine and cooling arrangement of FIG. 5.
Figure 5:
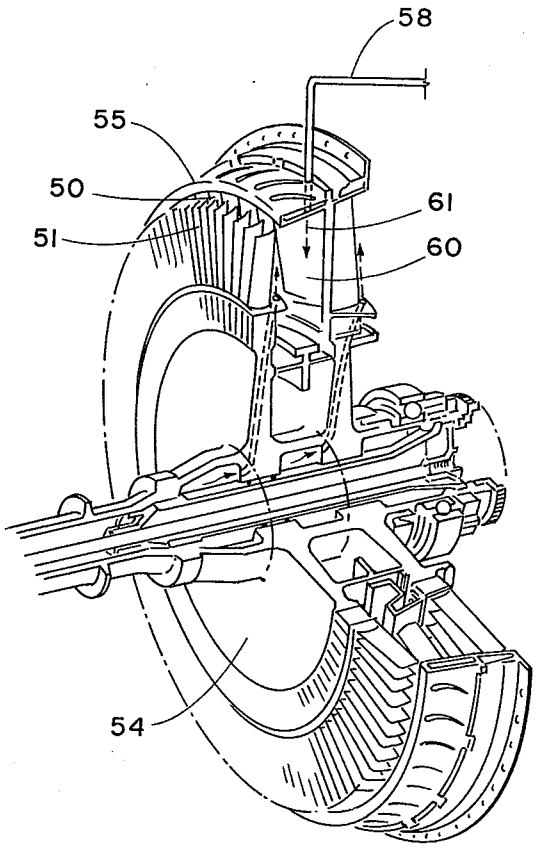
FIG. 5 is a perspective view of a conventional gas turbine with the cooling means of the present invention installed therein.

FIGS. 5 and 6 show the application of the invention to a conventional high temperature gas turbine. Numeral 50 identifies the passage for 3rd stage turbine blades 51 while the turbine hub is shown at 54 and the nozzle end wall is shown at 55. Cooling air is injected through a conduit 58 and a connecting hole in end wall 55 along the trailing edge of stator blades 60 as indicated by arrow 61. As seen in FIG. 6, the air injected through conduit 58 is directed into the recirculating regions at the trailing edge of stator blades 60 and along the leading edge of 4th stage turbine blades 64. Coolant for cooling the trailing edges of the 3rd and 4th stage turbine blades is supplied through passages 67 and 68 in the respective stage discs. In the case of the rotor blades, it is preferable to have cooling air directed as indicated by arrows 70 and 71 along the trailing edge of each blade and thus as many passages are formed as is desired to provide orifices in the respective discs selectively spaced from the ends of the blades for directing cooling air along these ends. Cooling air for the rotor blades is supplied from cavities in the base of the rotor frame such as 73 and 74 which are sealed by conventional means as indicated at 76–78 to form plenums through which air is distributed as indicated by arrows 80 and 81. It will be appreciated that the orifices in the turbine casing or turbine rotor through which cooling air is directed may be formed at selected angles so as to have the resultant direction of cooling air jets coincide with the trailing or leading edges desired to be cooled. It is noted that the cooling air injected along the trailing edge of stator blades 60 will provide a considerable cooling effect along 4th stage rotor blades 64.

In steady state operation, all the heat that is transferred to the trailing edge comes through the free shear layers on either side of the dead air region. The amount of coolant picked up and, therefore, the cooling protection afforded the trailing edge is proportional to the path lengths of recirculation paths 28 and 29. One of the major advantages of this means for introducing coolant is that the thickness of the trailing edge of the blade may be kept as low as possible thereby substantially lowering the blade losses in performance. Another advantage is elimination of the complex machining necessary for casting holes in the blades required in other methods of cooling the trailing edge. In addition, the only additional material needed to bring flow from a compressor or other pressurized source of coolant to end wall 36 is either external piping or internal passages connecting with plenums. This form of supply is extremely simple and produces a more efficient cooling which is achieved through elimination of the penalty suffered in conventional systems in the form of losses in efficiency due to larger blade wakes.

What is claimed is:

1. A system for cooling turbine blades in a turbine having a rotor, stator and rotor blades, and respective end walls comprising:

introducing coolant longitudinally in a stream along the trailing edge of a rotor blade in the recirculation region opposite said trailing edge, said coolant emanating from a site exterior to the blade so that blade strength is unaffected by said system, said coolant cooling the trailing edge by lowering the average temperature of the fluid in the recirculation region aft thereof, said coolant introduced in the form of a stream of cooling air injected through said stator blade end wall for cooling stator blades and through the rotor for cooling rotor blades.

2. The system as defined in claim 1 and further including cooling the leading edge of stator blades by introducing coolant longitudinally therealong so that cooling is effected by blanketing of at least a substantial portion of the leading edge.

3. The system as defined in claim 1 wherein cooling protection of blade trailing edges is effected by injecting said coolant centrally within the recirculation paths induced by boundary layer flow along adjacent surfaces of said blade, said recirculation paths being within the dividing streamlines of propulsive gases and entraining only an incidental portion of the hot gas flow from the free shear layer of gases along said blade surfaces.

4. The system as defined in claim 3 and further including means for injecting said streams of cooling air along the trailing edge of stator blades through orifices in the turbine end wall;

said means including a pressurized source of coolant and conduits for delivering said coolant to said orifices, said conduits and said orifices configured to direct coolant along a line substantially parallel to and spaced from the end of said blade.

5. The system as defined in claim 4 and further including means for injecting said streams of cooling air along the trailing edge of said rotor blades through orifices in said turbine rotor positioned one each at the base end of each rotor blade;

said rotor blade injecting means connected to said pressurized source of coolant and including passage means in said rotor for delivering coolant to said rotor orifices and plenum means in said rotor for distributing coolant to said passage means.

6. The system as defined in claim 5 wherein said passage means are canted at their outlet ends so that the resultant direction of cooling air is substantially parallel to said rotor blade trailing edges.

7. Means in a turbine having a rotor, stator and rotor blades, and respective end walls for cooling the leading and trailing edges of said stator and rotor blades and particularly high inlet temperature turbine blades without weakening the blades by internal cavities such as passages, holes or discontinuous slots comprising:

a pressurized source of coolant;

means for delivering said coolant to the vicinity of said blade edge ends; and means for directing said coolant longitudinally along and spaced from said blade edges so as to effect cooling of said leading edges by blanketing at least a substantial portion thereof with coolant and cooling of said trailing edges by injecting said coolant centrally within the dead air region therealong.

8. The cooling means as defined in claim 7 wherein said means for directing coolant along the trailing edges of stator blades include orifices in the blade-supporting end wall and conduits for delivering coolant to said orifices, said orifices selectively sized and spaced from said trailing edges so that a jet stream of coolant is injected centrally with respect to recirculation paths induced in said dead air region by boundary layer flow along adjacent surfaces of each of said blades.

9. The cooling means as defined in claim 8 and further including means for injecting jet streams of coolant along the trailing edges of rotor blades;

said last mentioned means including orifices in the turbine rotor positioned at least one opposite the trailing edge of said rotor blades, plenum means in said rotor communicating with said source of coolant, and passage means in said rotor for delivering coolant from said plenum means to said orifices.

10. The cooling means as defined in claim 9 wherein said passage means are canted at their outlet ends so that the resultant direction of coolant is substantially parallel to said rotor blade trailing edges.

* * * * *